United States Patent [19]

Kaga

[11] 4,200,284

[45] Apr. 29, 1980

[54] GAME IN WHICH OBJECTS ARE DISCHARGED FROM A RECEPTACLE

[75] Inventor: Takashi Kaga, Tokyo, Japan

[73] Assignee: Tomy Kogyo Co., Inc., Tokyo, Japan

[21] Appl. No.: 892,073

[22] Filed: Mar. 31, 1978

[30] Foreign Application Priority Data

Apr. 13, 1977 [JP] Japan ..... 52/46933[U]

[51] Int. Cl.[2] ..... A63F 9/00

[52] U.S. Cl. ..... 273/1 R

[58] Field of Search ..... 273/1 R, 1 E, 1 M

[56] References Cited

U.S. PATENT DOCUMENTS 3,754,759 8/1973 Breslow et al. ..... 273/1 R

*Primary Examiner*—Paul E. Shapiro

*Attorney, Agent, or Firm*—Edward D. O'Brian

[57] ABSTRACT

A game can be constructed so as to include a receptacle located on a base in such a manner that the receptacle is moved in an endless path as the game is played. The receptacle used is adapted to carry a plurality of objects and to discharge such objects as the game is played. A plurality of actuating structures are provided on the base for causing the discharge of objects from the receptacle. Each of these actuating structures includes a manually operated actuator and a contact member which is moved when the actuator is operated. The contact members are capable of being moved so as to cause the discharge of an object carried by the receptacle as the receptacle is moved adjacent to the contact member during its travel in the endless path. The receptacle may be shaped as an egg-laying animal and the actuator structures may be used to cause the animal discharge simulated eggs.

17 Claims, 8 Drawing Figures

FIG. 1.
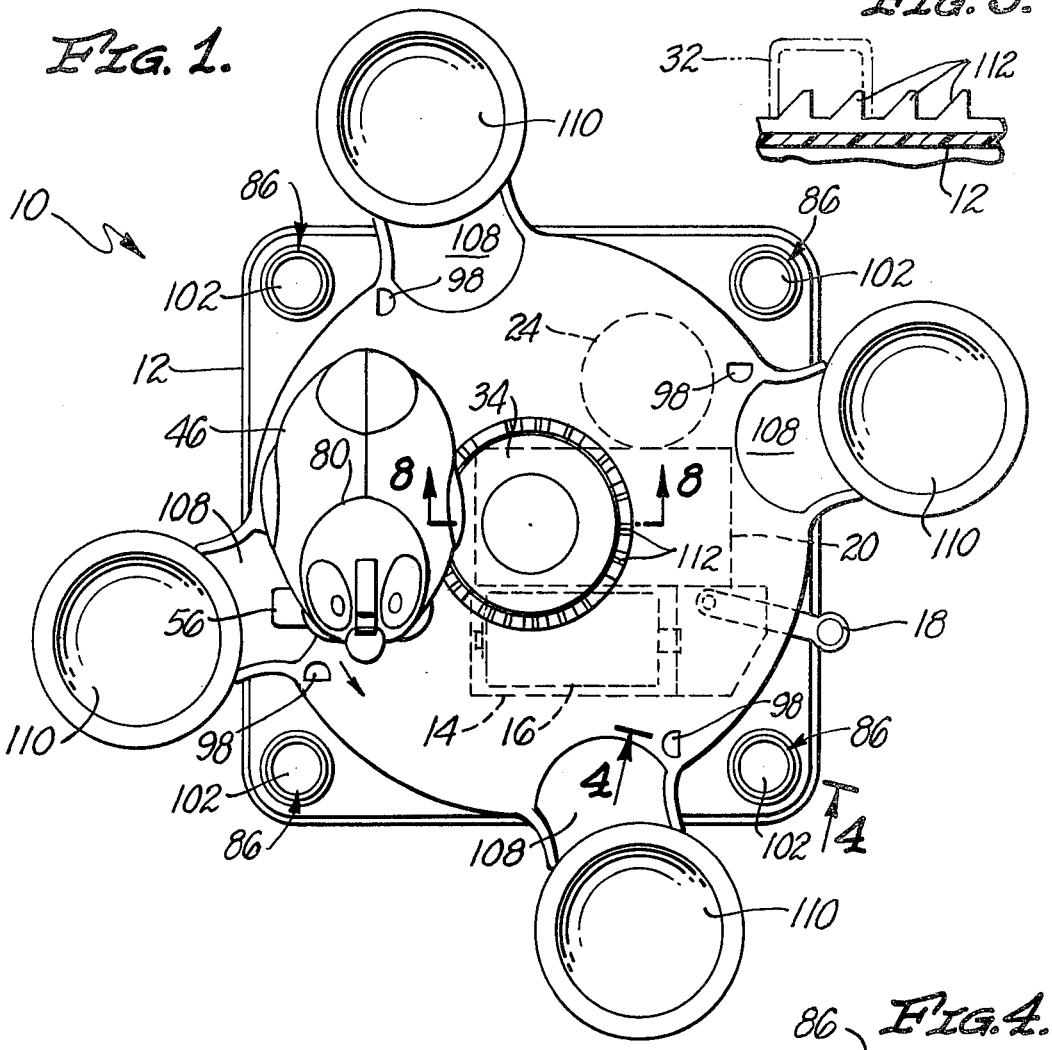
FIG. 3.
FIG. 2.
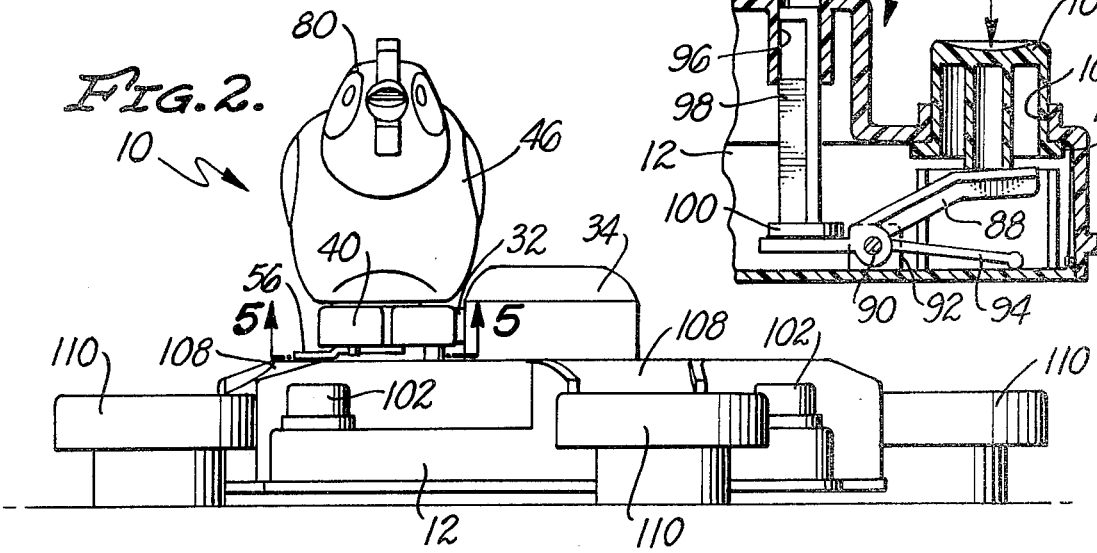
FIG. 4.
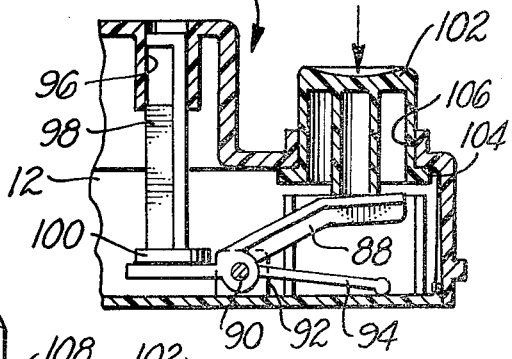

GAME IN WHICH OBJECTS ARE DISCHARGED FROM A RECEPTACLE

BACKGROUND OF THE INVENTION

The invention set forth in this specification pertains to new and improved games.

Although many hundreds of different games of different types have been developed and used it is considered that a continuing need exists for new and improved games. More specifically it is considered there is a continuing need for children's games of a mechanical character tending to require active individual participation which effectively stimulates the interest and imagination of individuals using these games. Such a game should require a modicum of coordination such as possessed by a normal child, but it also should be of such a character as not to be beyond the mental capabilities of a child. Further, from a commercial standpoint any new child's game of the type indicated should be comparatively inexpensive and reliable from a mechanical standpoint.

SUMMARY OF THE INVENTION

The invention is intended to provide new and improved games which fulfill a part of the continuing need for children's games indicated in the preceding discussion. The invention is further intended to provide games which can be manufactured at a reasonable cost, which are reliable from a mechanical standpoint, and which are capable of being constructed to withstand the normal abuse received by toys. The invention is also intended to provide games which may be easily and conveniently played by individuals of a comparatively young age which effectively stimulate the interest and imagination of such individuals.

In accordance with this invention these and various other objects of the invention are achieved by providing a game which comprises: a base; a receptacle located on said base, the receptacle being adapted to carry a plurality of objects and to discharge these objects, means for moving the receptacle in an endless path on the base, a plurality of actuating means for engaging at least a part of the receptacle so as to cause the removal of objects carried by the receptacle, the actuating means being located on the base adjacent to the path, each of the actuating means having a manually operated actuator and a contact member located relative to the actuator so as to be capable of being temporarily moved by actuation of the actuator from a normal position to a position to cause the discharge of an object carried by the receptacle.

BRIEF DESCRIPTION OF THE DRAWINGS

Because of the nature of the invention it is best more fully explained with reference to the accompanying drawings in which:

FIG. 1 is a top plan view of a presently preferred embodiment or form of a game in accordance with this invention;

FIG. 2 is a front elevational view of the game shown in FIG. 1;

FIG. 3 is a partial cross-sectional view at an enlarged scale indicating ratchet-like cam members as used in the game;

FIG. 4 is a partial cross-sectional view at an enlarged scale taken at line 4—4 of FIG. 1;

Figure 5:
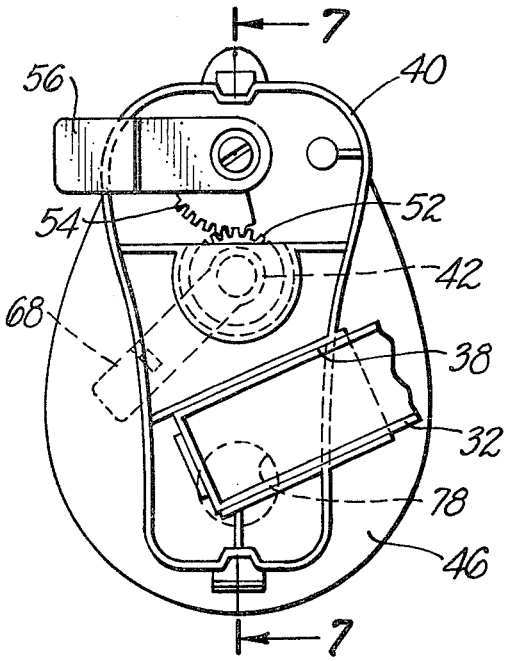
FIG. 5 is a partial cross-sectional view at an enlarged scale taken at line 5—5 of FIG. 2.

The particular game illustrated is a presently preferred embodiment or form of a game in accordance with the invention. This game incorporates the features or principles of the invention set forth and defined in the appended claims. These principles or features can easily be embodied within a wide variety of differently appearing and differently constructed games through the use or exercise or routine engineering skill such as is commonly found in the toy industry.

DETAILED DESCRIPTION

In the drawings there is shown a game 10 which is constructed so as to include a hollow base 12. Within this base 12 there is located a separate housing 14 which is adapted to contain a conventional battery 16 and a switch 18 for controlling the flow of current from the battery 16. There is also located within the base 12 a further housing 20 carrying a conventional electric motor (not shown) and gear train (not shown) used to turn an upstanding shaft 22. If desired, mechanical power may also be derived from the motor within the housing 20 for the purpose of actuating a known or conventional noise making mechanism 24. The motor is of course connected to the battery 16 and the switch 18 in a conventional manner.

The shaft 22 is attached to a mounting plate 26 so as to turn this plate 26 as the game 10 is used. Upstanding parallel lugs 28 on the plate 26 carry a pivot pin 30 used to mount an elongated arm 32 so that this arm extends outwardly from the shaft 22 as shown. Preferably a small cover 34 having an opening 36 to accommodate the arm 32 is mounted on the plate 26 for purpose of concealing the manner in which the arm 32 is mounted.

This arm 32 fits within a socket 38 on a platform 40 which in the game 10 is shaped so as to more or less simulate the feet of a chicken. This platform 40 carries an upstanding mounting shaft 42 which extends through an interior non-round cavity 44 in the receptacle 46. This receptacle 46 is shaped so as to reasonably resemble the body of an egg-laying animal such as a chicken. A sleeve 48 is fitted over the shaft 42 so as to also extend from the platform 40 upwardly through the cavity 44.

This sleeve 48 is provided with a non-round plate 50 which fits closely within the interior of the cavity 44 so as to cause pivotal movement of the receptacle 46 each time the sleeve 48 is rotated. Rotation of this sleeve 48 is caused through the use of a gear 52 which is located on the sleeve 48 so as to mate with a sector gear 54 attached to a control arm 56. This control arm 56 extends from the platform 40 and is pivotally secured to the platform 40 through the use of a cylindrical shaft-like pin 58 and a fastener 60.

With this construction each time the control arm 56 serves as a part of the receptacle 46 which is engaged so as to be rotated, such rotation will be transmitted through the sector gear 54 to the gear 52 so as to cause rotation of the sleeve 48. Because the plate 50 cannot rotate with respect to the receptacle 46 this will cause rotation of this rceptacle 46 relative to the platform 40.

The amount of such rotation of the receptacle 46 relative to the platform 40 may be conveniently limited by providing a pin 62 on the plate 50 which extends downwardly through an opening 64 in the bottom of the cavity 44 in order to engage an internal wall 66 on the platform 40.

The shaft 42 also carries an arm 68 which extends outwardly from the shaft 42 so as to be capable of fitting within a notch 70 in a chute 72 located within the receptacle 46. This arm 68 is secured in place by means of another fastener 60. A small wire spring 74 extends generally around the fastener 60 securing the arm 68. One end (not separately numbered) of this spring 74 is engaged with a hook-like element 76 on the arm 68 while the other end (not illustrated) bears against the interior of the receptacle 46.

This spring 74 serves to bias the receptacle 46 relative to the platform 40 in what may be referred to as a normal position as indicated in FIGS. 1, 2 and 5 in which the receptacle 46 is located generally above the platform 40. In this normal position a discharge opening 78 leading from the chute 72 is located directly above and immediately adjacent to the platform 40. The construction described in connection with the platform 40 and the receptacle 46 permits the receptacle 46 to be rotated or pivoted with respect to the platform 40 each time the control arm 56 is moved.

Figure 6:
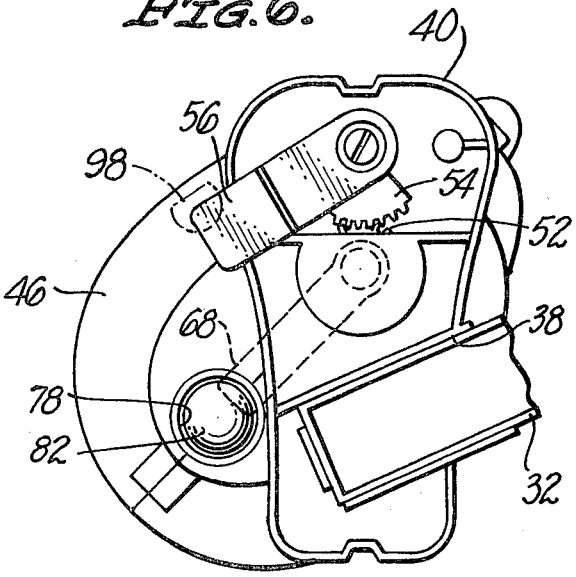
FIG. 6 is a view corresponding to FIG. 5 in which certain parts are shown in the positions they occupy at one point during the operation of the game.
Figure 8:
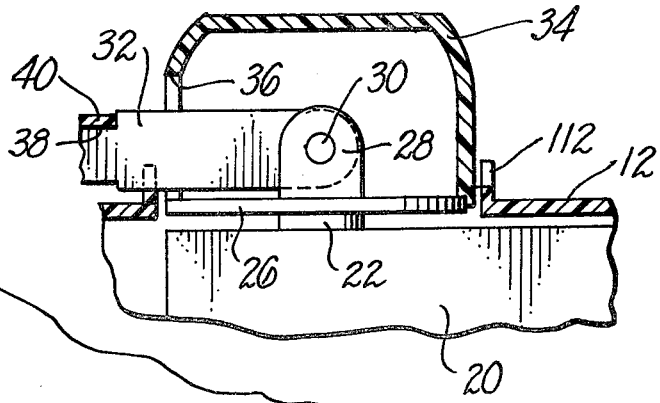
FIG. 8 is a partial cross-sectional view at an enlarged scale taken at line 8—8 of FIG. 1.
Figure 7:
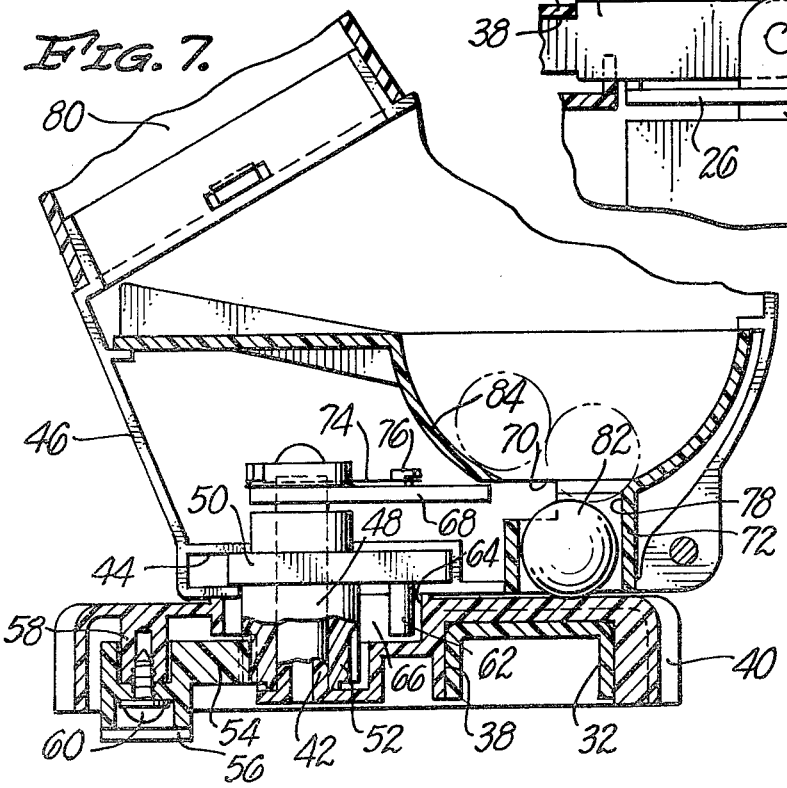
FIG. 7 is a cross-sectional view taken at line 7—7 of FIG. 5.

When the control arms 56 is engaged so as to move the receptacle 46 adequately this discharge opening 78 is located at one side (not separately numbered) of the platform 40 so as to be exposed or uncovered. When the receptacle 46 is in this position the arm 48 extends through the notch 70 so as to block movement into the chute 72. However, any content within the chute 72 may pass through the opening 78 when the receptacle 46 is located in this offside manner as indicated in FIG. 6.

The purpose of this structure is best explained further with reference to the intended utilization of the receptacle 46. A cover or lid 80 shaped so as to simulate the head of an egg-laying animal such as a chicken is provided on the receptacle 46 so that a series of small marbles 82 simulating eggs can be located within the interior of the receptacle. Such items rest upon a hopper-like bottom 84 leading to the chute 72 which is provided for the purpose of conveying these marbles 82 into the chute 72.

The chute 72 is dimensioned so as to accommodate a single marble 82. Normally this marble 82 is retained in the chute 72 by the position of the platform 40. When, however, the receptacle 46 is turned, this marble 82 in the chute 72 is free to fall from the chute through the opening 78. The receptacle 46 moves relative to the arm 68 as the receptacle 46 moves relative to the platform 40 so as to permit discharge of such a marble 82. Such movement between the arm 68 and the receptacle 46 places the arm 68 so that it blocks off the chute 72 in order to prevent more than one marble 82 from being discharged until such time as the receptacle 46 has been returned to its normal initial position.

From the preceding it will be apparent that an important aspect of the game 10 is in controlling the removal or discharge of items such as the marbles 82 from within the interior of the receptacle. Such removal is caused through the appropriate manipulation of what may be referred to as actuating means 86 as are indicated in FIG. 4 of the drawing. In the game 10 four of these means 86 are provided. The number used will normally be determined by the number of players to be accommodated in using the game 10. Each of the actuator means 86 includes a lever 88 pivotally mounted within the base 12 by a pivot pin 90 supported by conventional lugs 92. Preferably, but not necessarily, each lever 88 is formed out of a comparatively resilient, elastomeric material so as to include an elongated arm 94 serving as a spring which serves to bias the lever 88 into a normal or initial position as indicated in FIG. 4.

Each of the actuator means 86 also includes a linear bearing 96 located on the base 12 and a sliding, elongated contact member 98 mounted in a bearing 96 so as to extend downwardly therefrom. Each of the contact members 98 includes a head 100 of larger dimension than the bearing 96 with which it is associated so as to limit its upward movement. The heads 100 in the actuating means 86 rest against the levers 88 in such a manner than when these levers 88 are manually manipulated the levers 88 serve to drive or propel upwardly the contact members 98 to a sufficient extent so that these levers project material from the base 12. If desired small buttons 102 provided with bottom retainer flanges 104 may be mounted in sliding bearings 106 for the purpose of moving the levers 88 in order to propel the contact members 98 upwardly.

With the game 10 as the shaft 22 is turned the platform 40 and the receptacle 46 are continuously moved in an endless circular path (not shown) which extends adjacent to each of the individual actuating means 86. As this occurs the control arm 56 passes immediately above the various contact members 98 described in the preceding. The control arm 56, however, is located sufficiently above the base 12 so that the levers 88 cannot be manipulated to merely push the contact members 98 upwardly to a sufficient extent to engage the control arm 56.

Instead in order to actuate this control arm 56 it is necessary to apply a physical force or blow to a contact member 98 in order to drive such a contact member 98 upwardly to an extent beyond the distance it can be pushed up by merely pushing on a lever 88. As a result of this as the receptacle 46 is turned an individual player must hit a button 102 so as to physically drive a contact member 98 upwardly to a sufficient extent so that it can be engaged by the control arm 56 during movement of the receptacle 46 to a sufficient extent so that there is physical contact with the control arm 56 which is adequate to cause rotation of the receptacle 46.

When this occurs a marble 82 will be discharged as indicated in the preceding discussion. Ramps 108 leading to retaining cups 110 may be provided on the base 12 for the purpose of receiving and collecting individual marbles 82 which have been discharged as a result of the manipulation of actuating means 86 as indicated in the preceding discussion. As the game 10 is played the individual obtaining the maximum number of marbles 82 in a cup 110 is considered the winner of the game.

It is possible to increase the amusement value of the game 10 by incorporating on the base 12 around the plate 26 a sequence of ratchet-like cams 112 as indicated in FIG. 3 of the drawing. These cams 112 are located where they will physically engage the arm 32 during the movement of the receptacle 46. Such physical engagement will elevate the arm 32, the platform 40, and the receptacle 46 for a brief instant until the arm 32 falls back to an original elevation as the shaft 22 is turned.

It is believed it will be apparent from the aforegoing that the game 10 is a comparatively simple, effective structure which fulfills the various objectives of the present invention. The principles of this game 10 can obviously be utilized in various games which are closely related to the precise game itself through the use or exercise of routine skill.

I claim:

1. A game which comprises:

a base, a receptacle being located on said base, said receptacle being adapted to carry a plurality of objects and including a discharge means capable of being engaged to cause the discharge of said objects from said receptacle, means for moving said receptacle in an endless path on said base, a plurality of actuating means for engaging said discharge means so as to cause the removal of objects carried by said receptacle, said actuating means being located on said base adjacent to said path, each of said actuating means having a manually operated actuator and a contact member located relative to said actuator so as to be capable of being temporarily moved by actuation of said actuator from a normal position to a position to engage said discharge means to cause the discharge of an object carried by said receptacle.

2. A game as claimed in claim 1 wherein:

each of said actuators is a lever and each of said contact means is a member capable of being propelled upwardly away from the lever with which it is associated when the lever with which it is associated is manually engaged.

3. A game which comprises:

a base, a receptacle located adjacent to said base, said receptacle having a discharge opening located in the bottom thereof, discharge control means for controlling discharge of an item located within said receptacle through said discharge opening, said discharge control means being located on said receptacle and being capable of being actuated so as to permit discharge through said discharge opening, said discharge control means normally preventing discharge through said discharge opening, said discharge control means being capable of being actuated from the exterior of said receptacle so as to permit discharge through said discharge opening, drive means for moving said receptacle along a continuous path, said drive means being located on said base and connecting said receptacle to said base, actuating means for use in actuating said discharge control means so as to permit discharge through said discharge opening, said actuating means being located adjacent to said path and being capable of being manipulated so as to actuate said discharge control means during movement of said receptacle along said path.

4. A game as claimed in claim 3 wherein:

said actuating means includes contact means movably mounted so as to be capable of being moved from a normal position toward said path and capable of automatically returning to said normal position after being so moved, said actuating means also including lever means capable of being manually manipulated so as to deliver a physical blow to said contact means so as to move said contact means from said normal position toward said path.

5. A game as claimed in claim 4 wherein:

said contact means is capable of returning to its normal position through the action of gravity.

6. A game as claimed in claim 5 wherein:

said actuating means also includes a linear bearing located on said base, said contact means is an elongated member slidably mounted in said bearing.

7. A game as claimed in claims 3 or 6 including:

a plurality of said actuation means located so as to be spaced from one another along said path.

8. A game as claimed in claim 3 wherein:

said discharge control means includes a platform secured to said drive means so as to serve as a part of said drive means, said receptacle is movably mounted on said platform so as to be capable of being moved between a normal position in which said discharge opening is located adjacent to said platform so as to be covered by said platform and an open position in which said discharge opening is spaced from said platform so as to be uncovered by said platform, said discharge control means also including a control arm positioned so as to be capable of being engaged by a part of said actuating means which has been positioned through manipulation of said actuating means so as to be in a position to contact said control arm as said receptacle is moved along said path, said discharge control means also including motion transmitting means connecting said control arm and said receptacle for moving said receptacle so as to uncover said discharge opening when said control arm engages said part of said actuating means.

9. A game as claimed in claim 8 wherein:

said receptacle includes a chute leading to said discharge opening, said discharge control means also includes a blocking arm positioned within said receptacle, said blocking arm being located so as to block discharge from the interior of said receptacle through said chute when said receptacle is moved relative to said platform.

10. A game as claimed in claim 8 wherein:

said receptacle is pivotally mounted on said platform so as to be capable of being rotated relative to said platform, said control arm is pivotally mounted on said platform so as to extend therefrom, said motion transmitting means includes gear means connecting said control arm and said receptacle.

11. A game as claimed in claims 8 or 10 wherein:

said receptacle is shaped so as to simulate an egg-laying animal.

12. A game as claimed in claim 3 wherein:

said discharge control means includes a platform secured to said drive means so as to serve as a part of said drive means, said receptacle is pivotally mounted on said platform so as to be capable of being rotated between a normal position in which said discharge opening is located adjacent to said platform so as to be covered by said platform and an open position in which said discharge opening is spaced from said platform so as to be uncovered by said platform, said discharge control means also including a control arm pivotally mounted on said platform so as to be capable of being positioned so as to be capable of being engaged and moved from a usual position by a part of said actuating means which has been positioned through manipulation of said actuating means so as to be in a position to contact said control arm as said receptacle is moved along said path, said discharge control means also including gear means connecting said control arm and said receptacle for moving said receptacle so as to uncover said discharge opening when said control arm is moved from said usual position by engagement with said part of said actuating means, and spring means connecting said control arm and said receptacle for biasing said receptacle in said normal position and said control arm in said usual position.

13. A game as claimed in claim 3 wherein:

said drive means includes cam means for imparting irregular motion to said receptacle as said receptacle is moved along said path.

14. A game as claimed in claim 3 wherein:

said drive means includes a motor mounted on said base, a rotor driven by said motor and connected to said motor, and a drive arm extending outwardly from said rotor, said receptacle being mounted on said drive arm remote from said rotor.

15. A game as claimed in claim 14 wherein:

said drive arm is pivotally connected to said rotor, said drive means includes a plurality of cam means positioned on said base so as to engage and move said arm as said rotor is rotated.

16. A game as claimed in claim 3 wherein:

said drive means includes a motor mounted on said base, a rotor driven by said motor and connected to said motor, and a drive arm extending outwardly from said rotor, said receptacle being mounted on said drive arm remote from said rotor, said drive arm is pivotally connected to said rotor, said drive means includes a plurality of cam means positioned on said base so as to engage and move said arm as said rotor is rotated, said discharge control means includes a platform secured to to said drive means so as to serve as a part of said drive means, said receptacle is pivotally mounted on said platform so as to be capable of being rotated between a normal position in which said discharge opening is located adjacent to said platform so as to be covered by said platform and an open position in which said discharge opening is spaced from said platform so as to be uncovered by said platform, said discharge control means also including a control arm pivotally mounted on said platform so as to be capable of being positioned so as to be capable of being engaged and moved from a usual position by a part of said actuating means which has been positioned through manipulation of said actuating means so as to be in a position to contact said control arm as said receptacle is moved along said path, said discharge control means also including gear means connecting said control arm and said receptacle for moving said receptacle so as to uncover said discharge opening when said control arm is moved from said usual position by engagement with said part of said actuating means, and spring means connecting said control arm and said receptacle for biasing said receptacle in said normal position and said control arm in said usual position, said receptacle is shaped so as to simulate an egg-laying animal, said game includes a plurality of said actuating means, each of said actuating means including a linear bearing located on said base, an elongated member slidably mounted in said bearing and a lever located adjacent to said member, said lever being capable of being manipulated so as to deliver a blow to said member in order to propel said member upwardly into a position in which it is capable of being engaged by said control arm.

17. A game as claimed in claim 16 including:

a holder located adjacent to each of said actuating means, said holders being positioned so as to receive a discharge from said receptacle when said receptacle is moved so that said discharge opening is uncovered by said platform as a result of engagement between said member and said contact arm.

* * * * *